US007293774B1

(12) United States Patent
Shawd et al.

(10) Patent No.: US 7,293,774 B1
(45) Date of Patent: Nov. 13, 2007

(54) MOVING SHOOTING TARGET SYSTEM

(76) Inventors: Jarid G. Shawd, 40730 247th St., Mitchell, SD (US) 57301; Ryan G. Shawd, 40730 247th St., Mitchell, SD (US) 57301

( * ) Notice: Subject to any disclaimer, the term of this patent is extended or adjusted under 35 U.S.C. 154(b) by 0 days.

(21) Appl. No.: 11/380,305

(22) Filed: Apr. 26, 2006

(51) Int. Cl.
*F41J 9/00* (2006.01)

(52) U.S. Cl. ..... 273/359

(58) Field of Classification Search ..... 273/383–393, 273/406, 407, 359
See application file for complete search history.

(56) References Cited

U.S. PATENT DOCUMENTS

| | | | | |
|---|---|---|---|---|
| 631,175 | A | 8/1899 | Parnall | |
| 879,670 | A | 12/1908 | Petry | |
| 1,047,989 | A * | 12/1912 | Reeves | 124/26 |
| 1,080,301 | A | 12/1913 | Richmond | |
| 2,215,917 | A * | 9/1940 | Dreyer | 273/366 |
| 2,297,993 | A * | 10/1942 | Tratsch | 273/366 |
| 4,165,074 | A | 8/1979 | Bonser | |
| 4,540,182 | A | 9/1985 | Clement | |
| 5,087,053 | A * | 2/1992 | Head | 273/359 |
| 5,261,674 | A * | 11/1993 | Allison | 273/359 |
| 5,324,043 | A | 6/1994 | Estrella | |
| 6,007,429 | A | 12/1999 | Lubniewski | |
| 6,073,932 | A | 6/2000 | Elliott | |
| 6,179,619 | B1 | 1/2001 | Tanaka | |
| 6,257,583 | B1 | 7/2001 | Roberson | |
| 6,398,215 | B1 | 6/2002 | Carroll | |
| 6,402,641 | B1 | 6/2002 | Lee | |
| 6,478,301 | B1 | 11/2002 | Witmeyer | |
| 6,557,855 | B2 | 5/2003 | Wu | |
| 2005/0006848 | A1* | 1/2005 | Fort | 273/407 |
| 2005/0158412 | A1 | 7/2005 | Su et al. | |

* cited by examiner

*Primary Examiner*—Mark S Graham

(57) ABSTRACT

A moving shooting target system for providing a first stationary target that triggers a second moving target when stricken with a bullet. The moving shooting target system includes a frame with a shooting opening and a target reservoir, a first target attached to a support member, and a stopper member attached to the support member. The stopper member releases at least one second target from the target reservoir when the first target is stricken by a bullet. The released second target rolls along and through the shooting opening where a shooter is able to shoot the released second target.

19 Claims, 12 Drawing Sheets

MOVING SHOOTING TARGET SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to shooting target devices and more specifically it relates to a moving shooting target system for providing a first stationary target that triggers a second moving target when stricken with a bullet.

2. Description of the Related Art

Any discussion of the prior art throughout the specification should in no way be considered as an admission that such prior art is widely known or forms part of common general knowledge in the field.

Shooting target devices have been in use for years. Stationary targets for shooters to practice shooting have been in use for years (e.g. for rifles, archery, etc.). A common type of stationary target is a "bulls eye" which is comprised of a plurality of concentric circles for the shooter to aim at. Various other types of stationary targets are used such as bottles and cans supported upon various objects.

Moving targets have also been in use for years. For example, "clay pigeon" throwers release one or more frangible disks into the air with the purpose to be shot with pellets from a shotgun. Another type of moving target is a metal plate-like structure in various shapes (e.g. circular, animal shapes, etc.) that is pivotally attached to a structure and when stricken with a bullet falls over.

BRIEF SUMMARY OF THE INVENTION

In view of the foregoing disadvantages inherent in the known types of shooting targets now present in the prior art, the present invention provides a new moving shooting target system construction wherein the same can be utilized for providing a first stationary target that triggers a second moving target when stricken with a bullet.

The general purpose of the present invention, which will be described subsequently in greater detail, is to provide a new moving shooting target system that has many of the advantages of the shooting targets mentioned heretofore and many novel features that result in a new moving shooting target system which is not anticipated, rendered obvious, suggested, or even implied by any of the prior art shooting targets, either alone or in any combination thereof.

To attain this, the present invention generally comprises a frame with a shooting opening and a target reservoir, a first target attached to a support member, and a stopper member attached to the support member. The stopper member releases at least one second target from the target reservoir when the first target is stricken by a bullet. The released second target rolls along and through the shooting opening where a shooter is able to shoot the released second target.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a moving shooting target system that will overcome the shortcomings of the prior art devices.

A second object is to provide a moving shooting target system for providing a first stationary target that triggers a second moving target when stricken with a bullet.

Another object is to provide a moving shooting target system that does not require an external power source to operate.

An additional object is to provide a moving shooting target system that has a simple design for reduced cost and maintenance.

A further object is to provide a moving shooting target system that improves the interest of the shooter practicing their shooting skills.

Another object is to provide a moving shooting target system that may be utilized with respect to various types of firearms.

A further object is to provide a moving shooting target system that is portable.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

FIG. **6*a*** is a right side view of the present invention prior to a bullet striking the first target.

FIG. **6*b*** is a right side view of the present invention with the bullet striking the first target.

FIG. **7*a*** is a top view of the present invention prior to a bullet striking the first target.

Figure 7A:
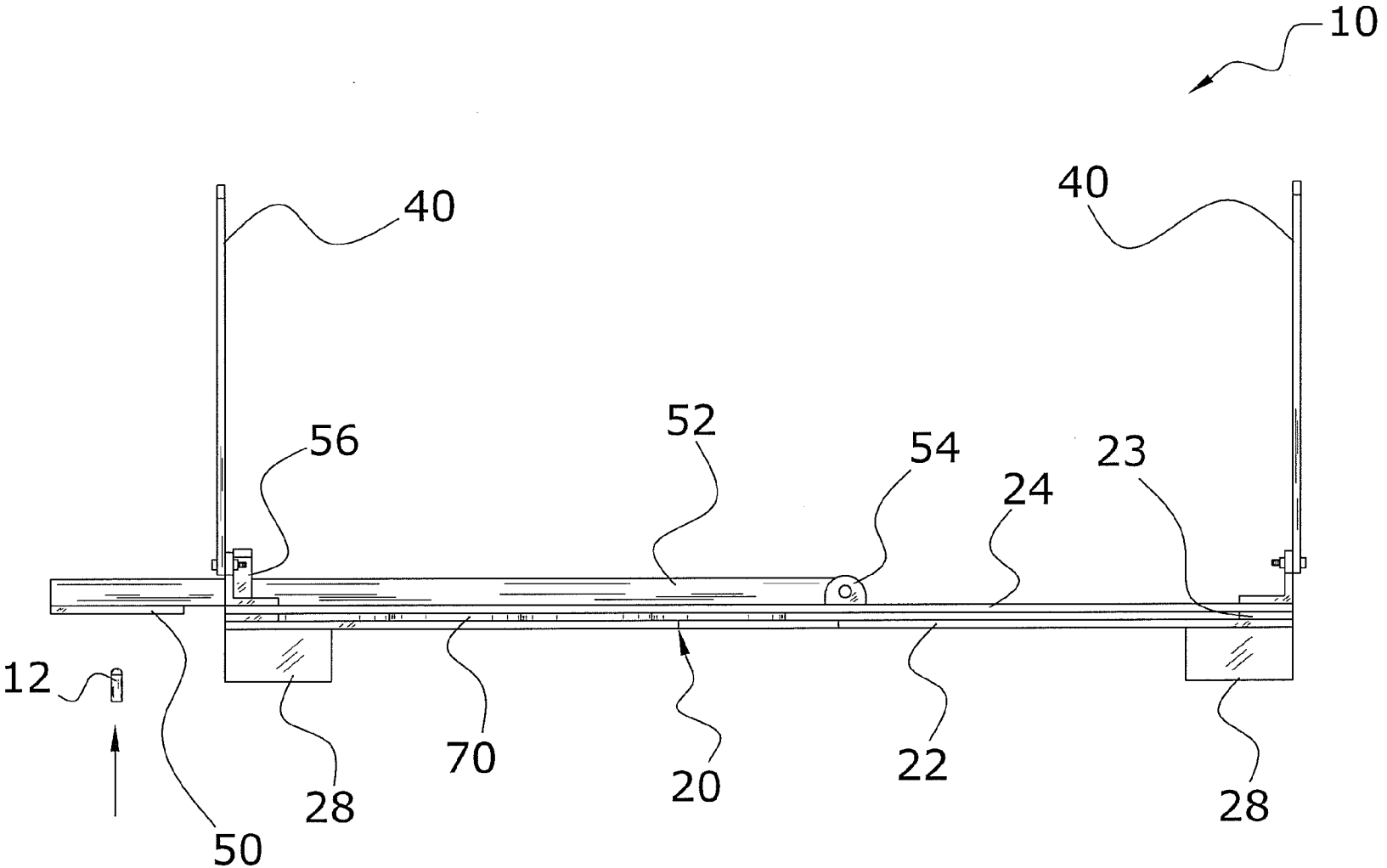
Figure 7B:
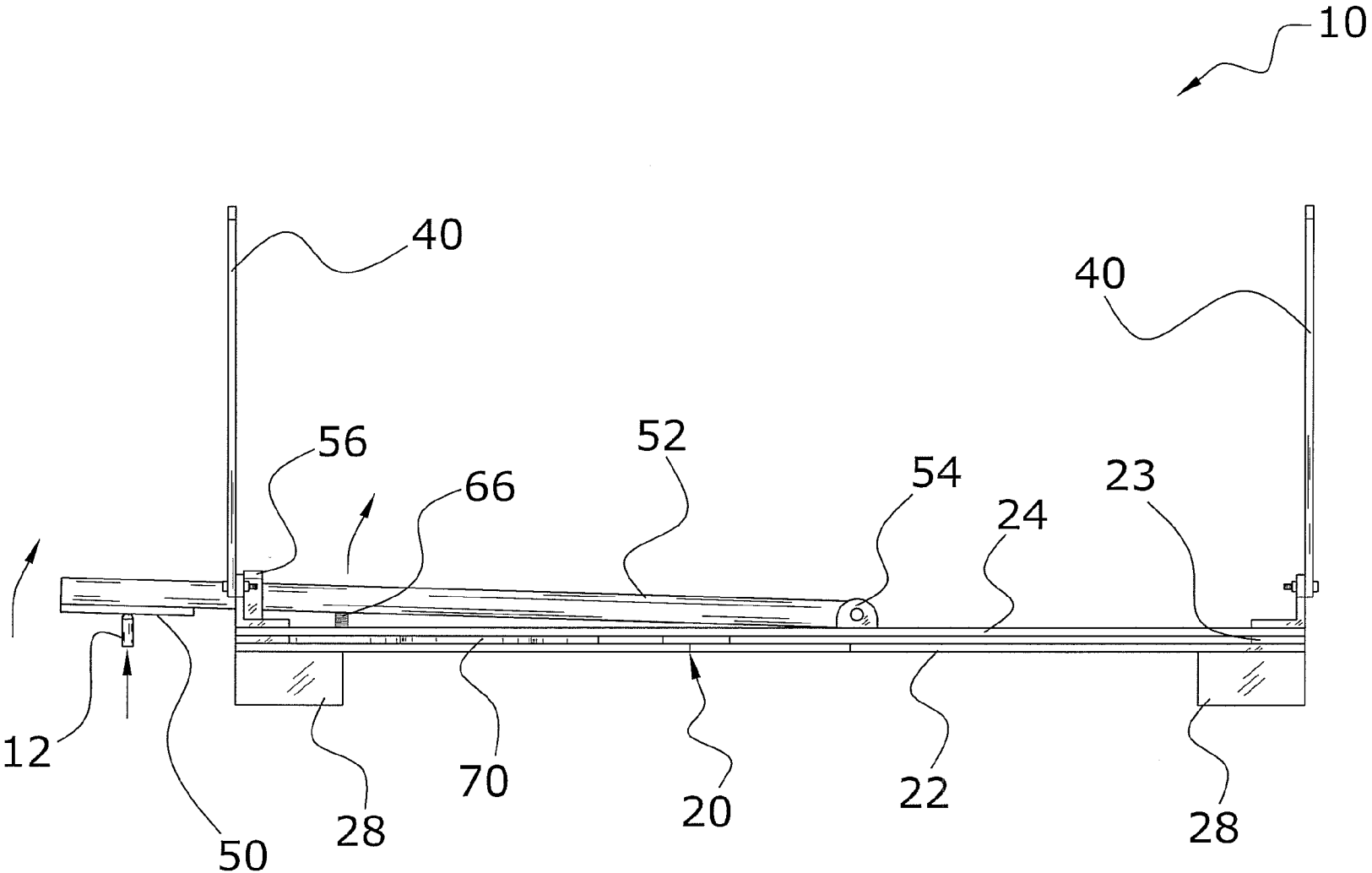

FIG. 7*b* is a top view of the present invention with the bullet striking the first target.

Figure 8A:
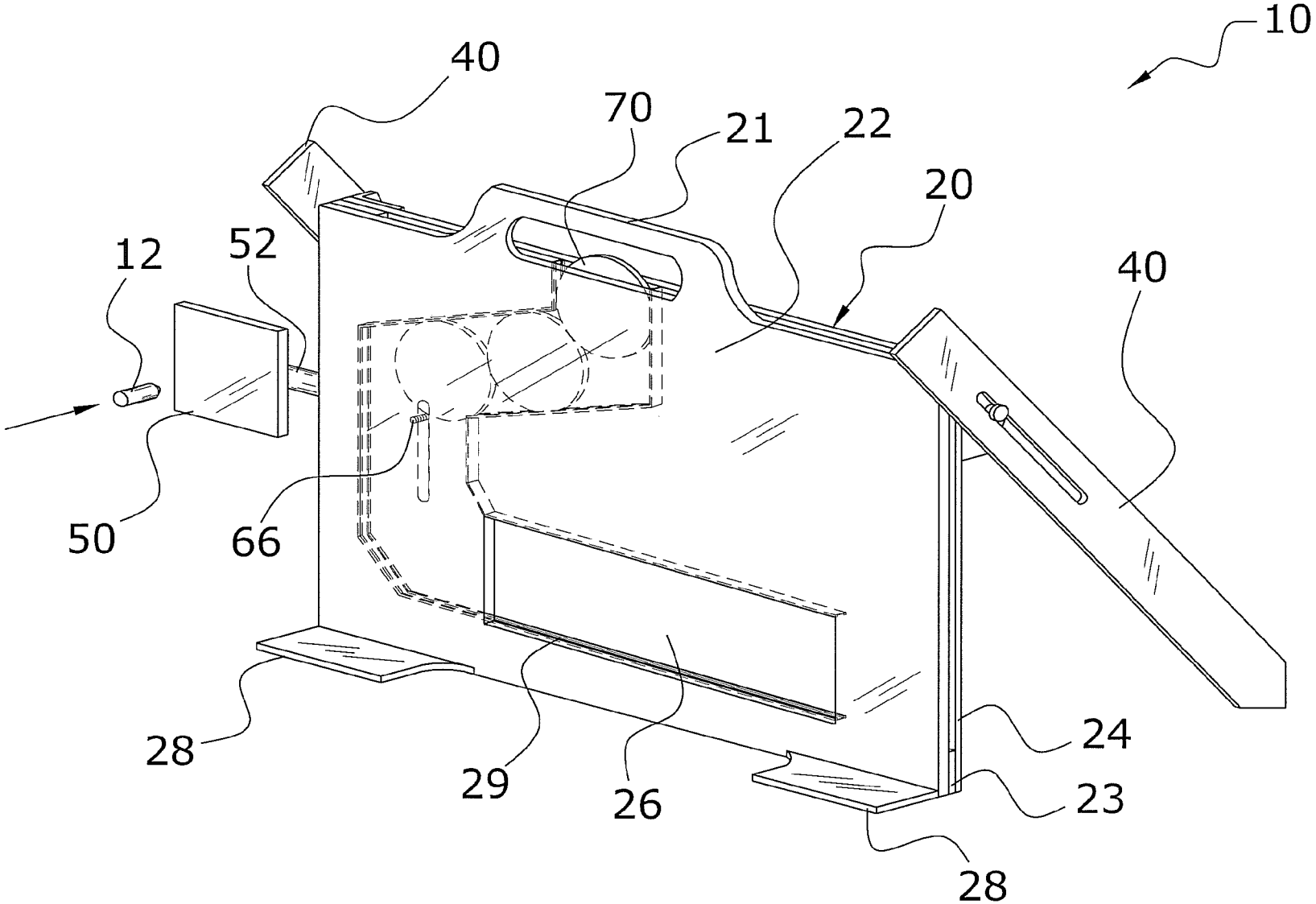

FIG. 8*a* is an upper perspective of the present invention prior to a bullet striking the first target.

Figure 8B:
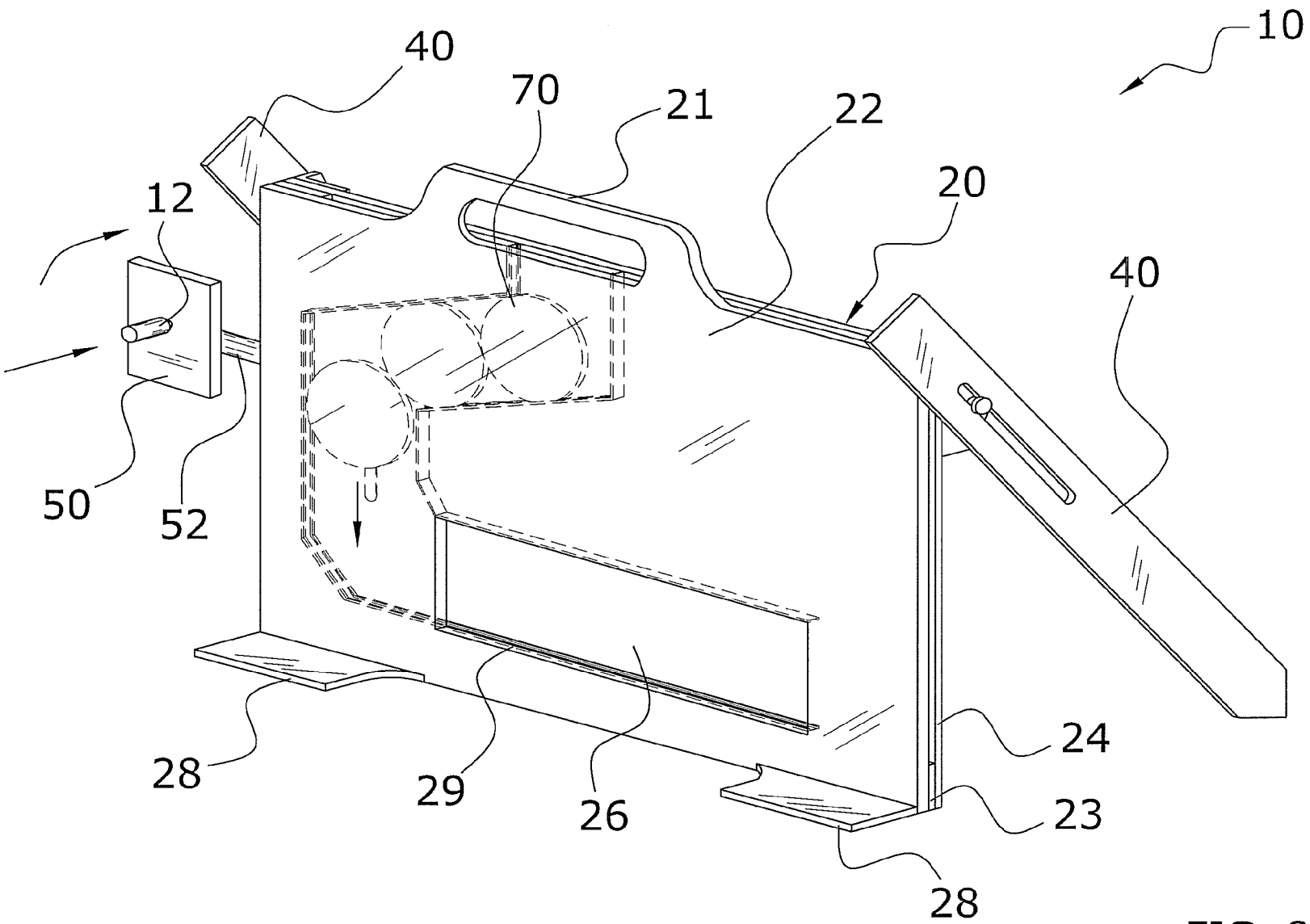

FIG. 8*b* is an upper perspective of the present invention with the bullet striking the first target thereby releasing at least one second target.

Figure 8C:
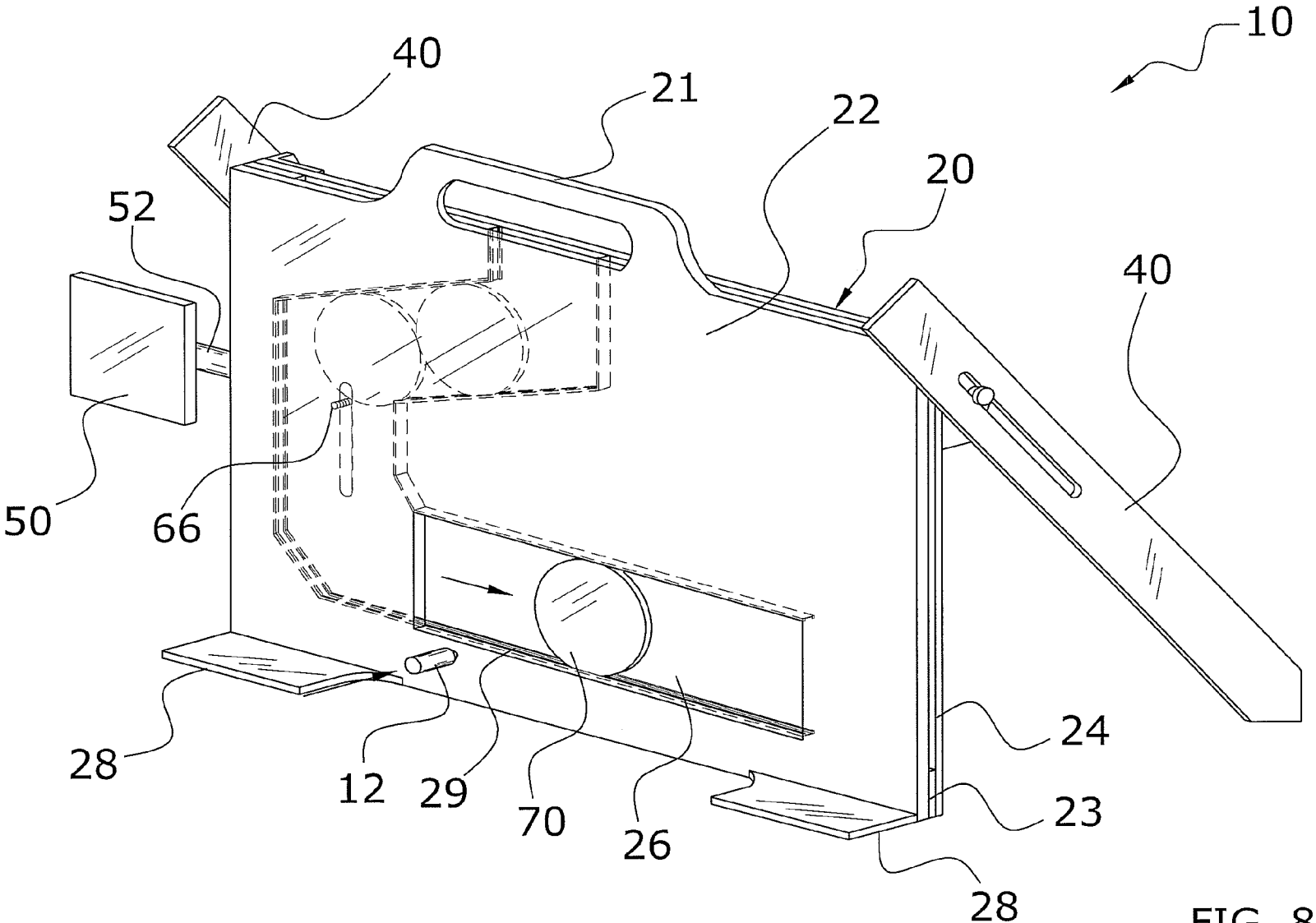

FIG. 8*c* is an upper perspective of the present invention after the bullet striking the first target with the released second target traveling through the shooting opening.

DETAILED DESCRIPTION OF THE INVENTION

A. Overview

Turning now descriptively to the drawings, in which similar reference characters denote similar elements throughout the several views, FIGS. 1 through 8*c* illustrate a moving shooting target system 10, which comprises a frame 20 with a shooting opening 26 and a target reservoir 25, a first target 50 attached to a support member 52, and a stopper member 66 attached to the support member 52. The stopper member 66 releases at least one second target 70 from the target reservoir 25 when the first target 50 is stricken by a bullet 12. The released second target 70 rolls along and through the shooting opening 26 where a shooter is able to shoot the released second target 70.

B. Frame

Figure 1:
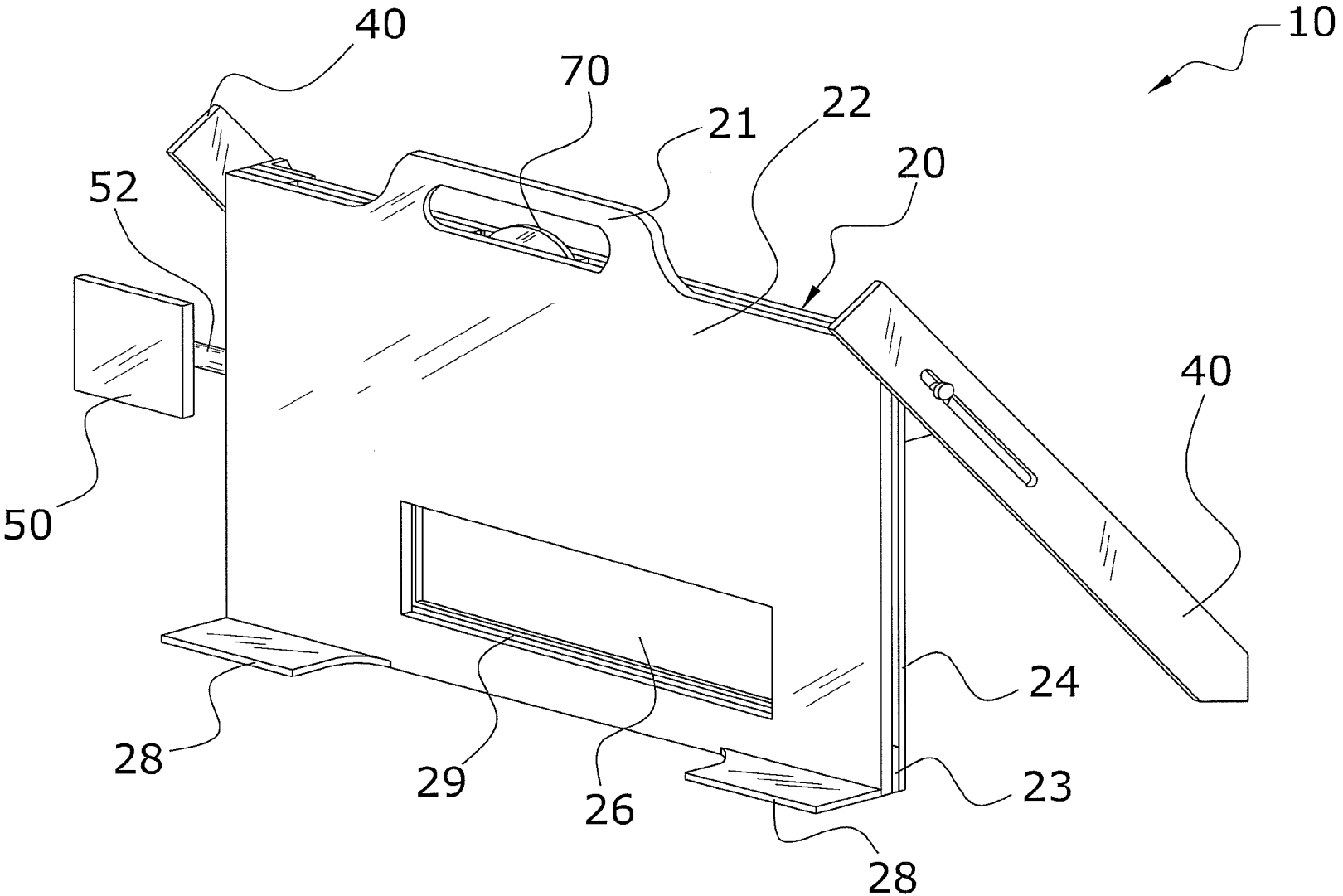
FIG. 1 is a front upper perspective view of the present invention.
Figure 2:
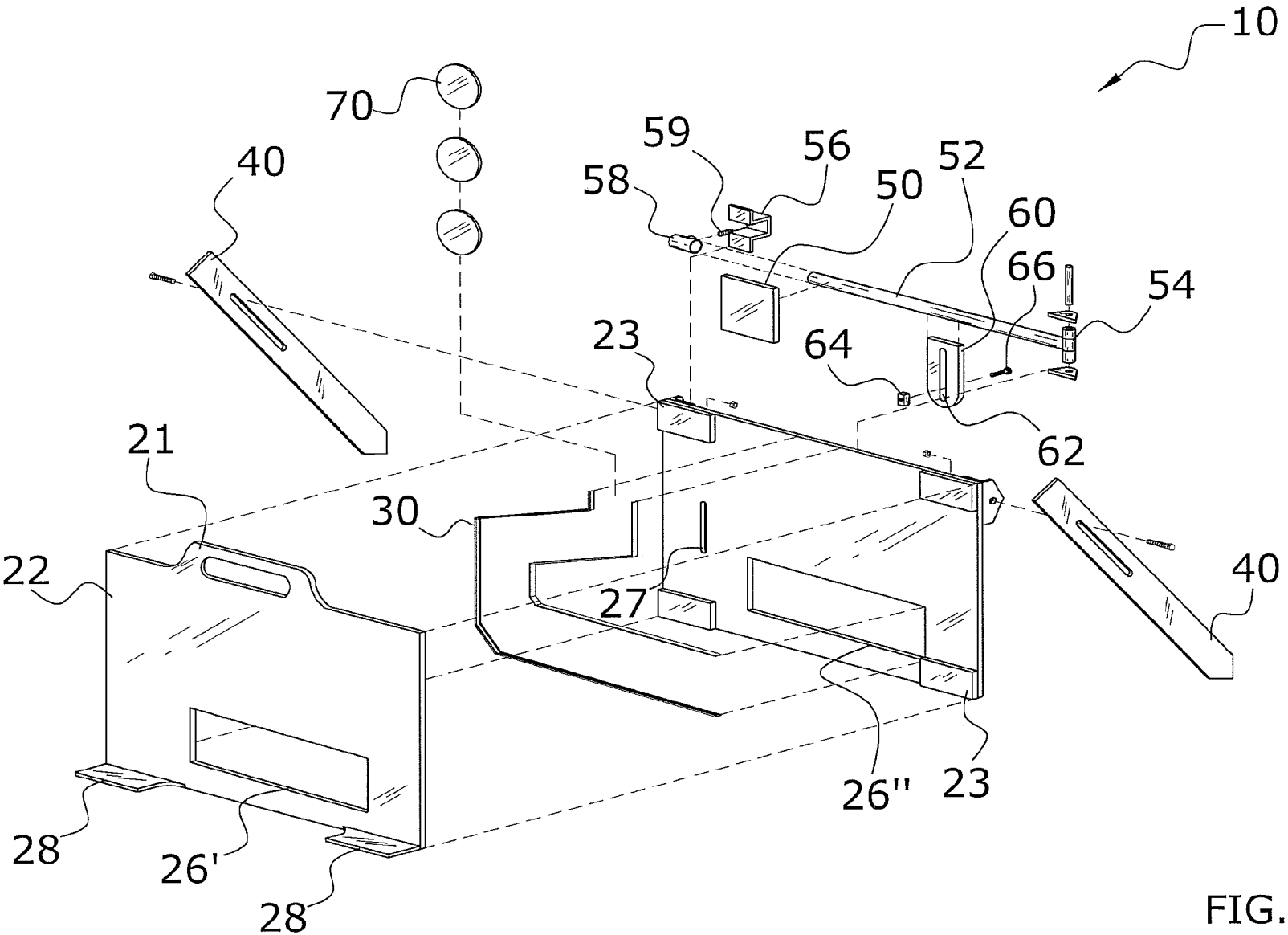
FIG. 2 is an exploded front upper perspective view of the present invention.

As shown in FIGS. 1 and 2 of the drawings, the frame 20 includes a handle 21, a shooting opening 26, a target reservoir 25 and a track 30 connecting the target reservoir 25 with the shooting opening 26. The target reservoir 25 is preferably positioned vertically above the shooting opening 26. The track 30 is preferably aligned in a substantially vertical manner between the target reservoir 25 and the shooting opening 26 as illustrated in FIG. 2 of the drawings. The handle 21 has an opening for a user to extend their hand through during transportation thereof.

A pair of feet 28 preferably extend forwardly from a bottom portion of the frame 20 as shown in FIGS. 1 and 2 of the drawings. The feet 28 provide forward stability to the frame 20 during use. A pair of legs 40 preferably rearwardly from the frame 20 as shown in FIGS. 1 and 2 of the drawings. The pair of legs 40 are preferably adjustable in length and rotational position with respect to the frame 20. The legs 40 preferably include slots that receive fasteners in an adjustable manner to secure the legs 40 to upper side portions of the frame 20 as shown in FIG. 1 of the drawings. The slots in the legs 40 allow the legs 40 to be lengthened. When not in use, the legs 40 may be pivoted in an substantially vertical position to be aligned with the frame 20 to compact storage thereof.

Figure 4:
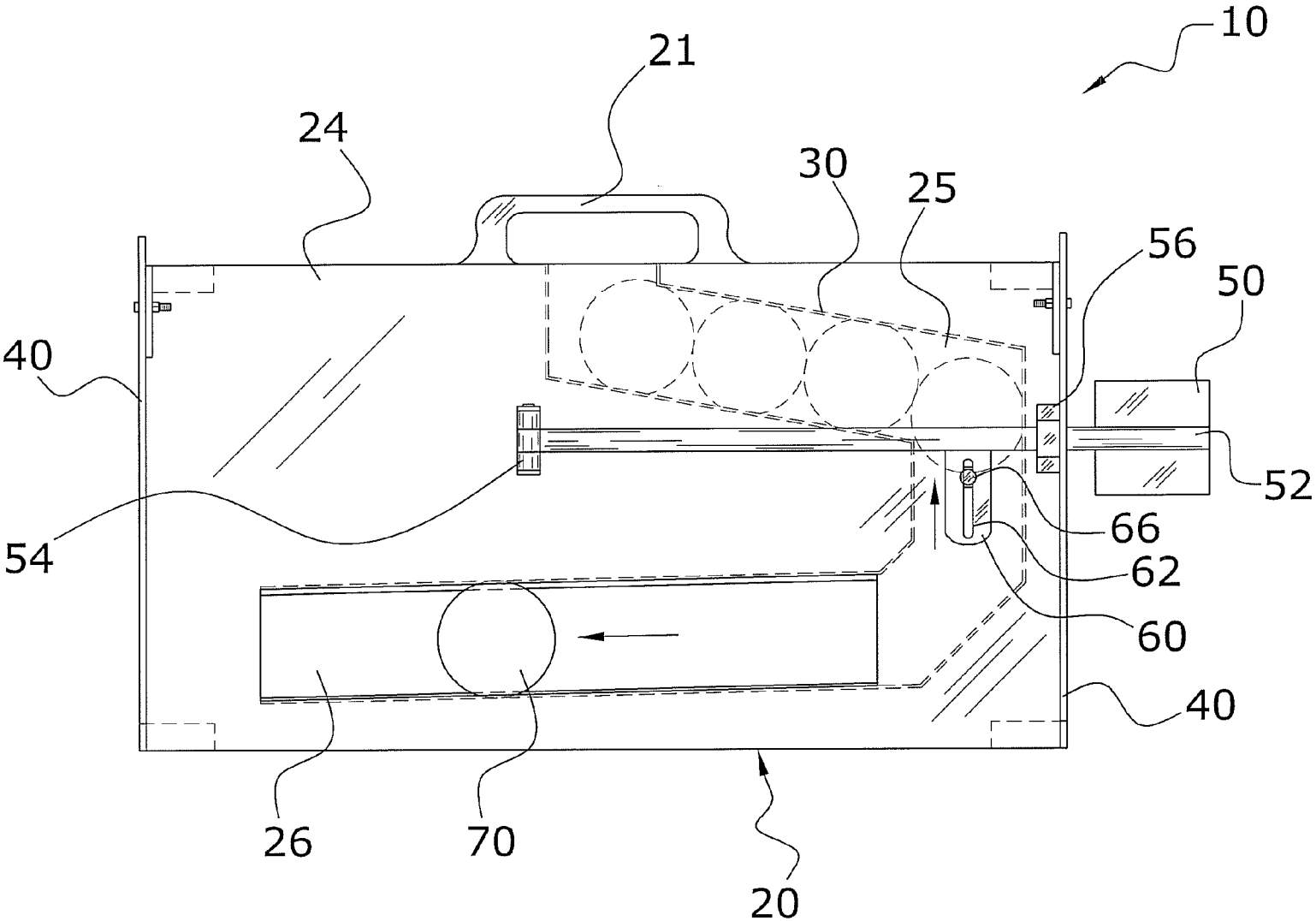
FIG. 4 is a rear view of the present invention with the stopper member positioned in a raised position.
Figure 5:
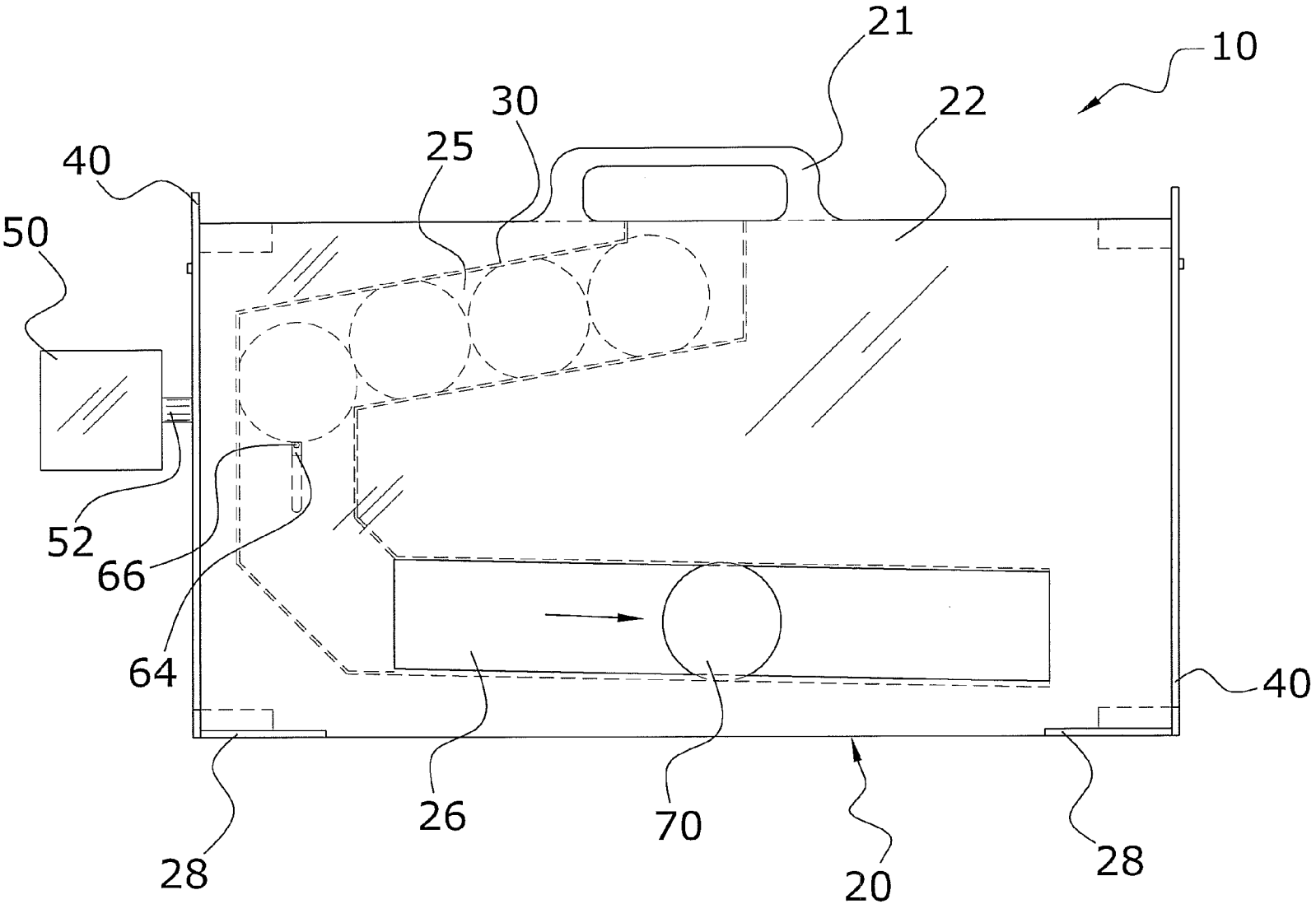
FIG. 5 is a front view of the present invention.

The shooting opening 26 is preferably substantially horizontal as shown in FIGS. 4 and 5 of the drawings. However, the shooting opening 26 may have an upward and downward angle from the initial portion of the shooting opening 26. The shooting opening 26 preferably has a height sufficient to see at least ninety-percent of a released second target 70 to provide convenient viewing by a shooter.

The frame 20 preferably includes a guide slot 29 extending downwardly from the shooting opening 26 for guiding a released second target 70. The guide slot 29 extends along a significant portion of the shooting opening 26 and allows the second target 70 to roll within substantially freely. The guide slot 29 is preferably substantially straight to prevent binding of the second target 70 during movement within the guide slot 29. The guide slot 29 is preferably sufficiently broader in width than the width of the second target 70 to allow for the second target 70 to fall rearwardly through the shooting opening 26 if stricken with a bullet 12. The frame 20 preferably does not retain an upper portion of a released second target 70 while the released second target 70 travels through the shooting opening 26. However, if frangible targets (e.g. clay pigeons) are used, there may be an upper slot within the shooting opening 26.

The frame 20 is preferably comprised of a front panel 22, a rear panel 24 and a plurality of spacers 23 attached between the front panel 22 and the rear panel 24. The front panel 22 includes a front shooting opening 26' and the rear panel 24 includes a rear shooting opening 26" as shown in FIG. 2 of the drawings. The front panel 22 and the rear panel 24 are preferably comprised of a material impermeable to bullets 12 including but not limited to steel panels.

C. Support Member

Figure 3:
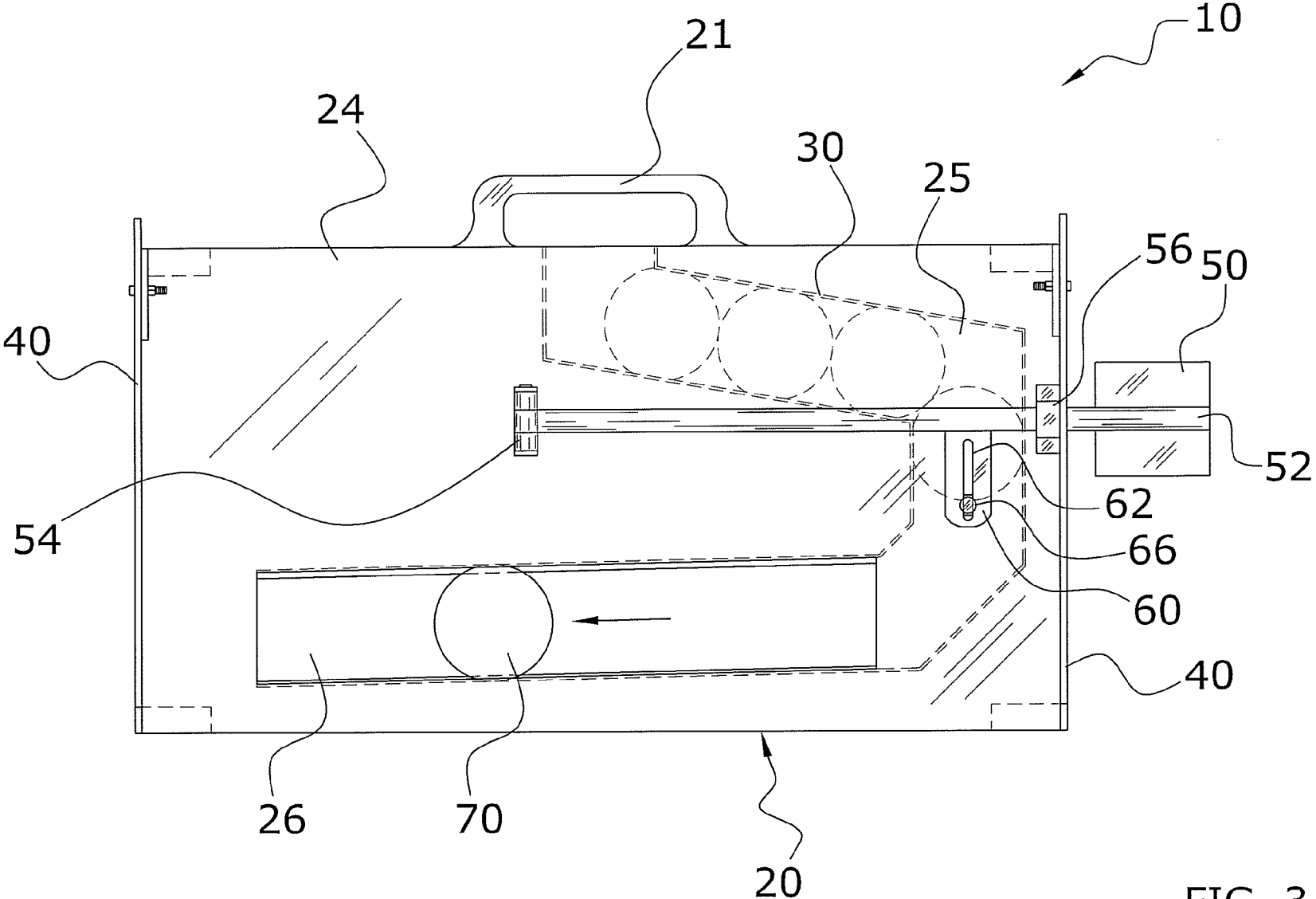
FIG. 3 is a rear view of the present invention with the stopper member positioned in a lowered position.

As shown in FIGS. 2, 3, 7*a* and 7*b* of the drawings, a support member 52 is pivotally attached to the frame 20. The support member 52 is comprised of an elongated structure that pivots rearwardly when the first target 50 is stricken by a bullet 12. The first target 50 is preferably attached to a distal portion of the support member 52 as best illustrated in FIG. 3 of the drawings. The first target 50 is preferably comprised of a broad shape (e.g. square, circle) and is comprised of a material impermeable to a bullet 12. The support member 52 is pivotally attached to the frame 20 via a hinge 54 or other pivot structure.

Figure 6A:
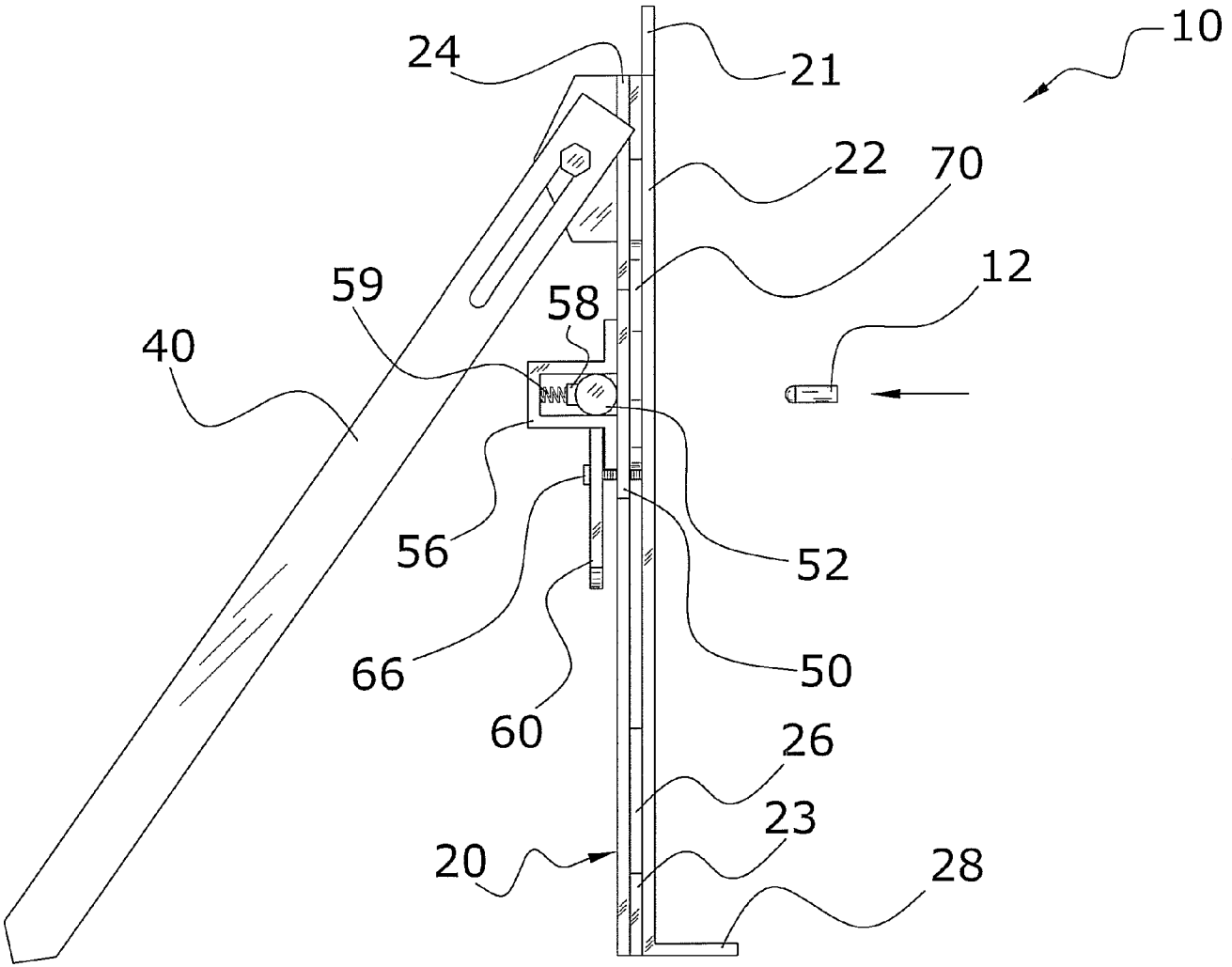
Figure 6B:
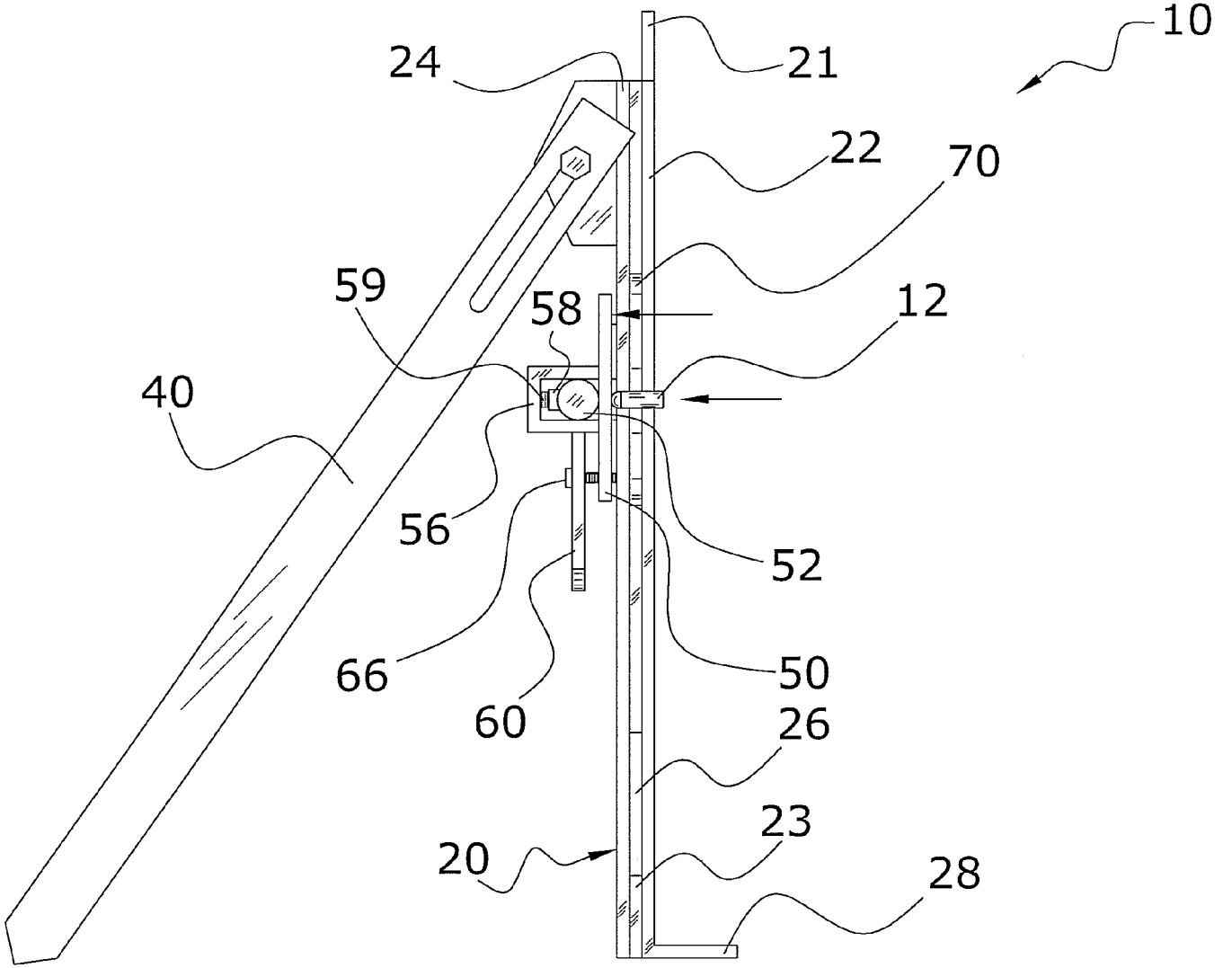

A guide member 56 is provided that slidably receives a distal portion of the support member 52 to allow the support member 52 to pivot with respect to the frame 20 as shown in FIGS. 2, 7*a* and 7*b* of the drawings. A bias member 59 is preferably positioned between the guide member 56 and the support member 52 to apply a forward biasing force upon the support member 52 thereby retaining the second targets 70 positioned within the target reservoir 25. The bias member 59 is preferably comprised of a compression spring as best illustrated in FIG. 2 of the drawings. A receiver member 58 is preferably attached to the support member 52 that has a recessed portion that receives the compression spring as best illustrated in FIGS. 6*a* and 6*b* of the drawings. When the first target 50 is stricken by a bullet 12, the force of the bullet 12 upon the first target 50 causes the support member 52 to pivot rearwardly thereby compressing the compression spring.

D. Stopper Member

The stopper member 66 is attached to the support member 52 and moves along with the support member 52. The stopper member 66 selectively engages a second target 70 within the target reservoir 25 to selectively prevent the second target 70 from passing through the track 30 to the shooting opening 26 when the support member 52 is biased forwardly by the biasing member as illustrated in FIGS. 6*a*, 7*a* and 8*a* of the drawings. When a bullet 12 strikes the first target 50 the support member 52 is pivoted so that the stopper member 66 is positioned into a release position that releases at least one second target 70 from the target reservoir 25 as shown in FIGS. 6*b*, 7*b* and 8*b* of the drawings.

The stopper member 66 is preferably adjustable to adjust a vertical drop distance for a released second target 70. The adjustment of the vertical drop distance allows for adjustment of the horizontal velocity within the shooting opening 26. For example, to increase the horizontal velocity, the vertical drop distance is increased to increase the amount of vertical speed generated prior to the second target 70 being redirected towards a horizontal velocity within the shooting opening 26 as shown in FIG. 4 of the drawings. To decrease the horizontal velocity, the vertical drop distance is decreased to decrease the amount of vertical speed generated prior to the second target 70 being redirected towards a horizontal velocity within the shooting opening 26 as shown in FIG. 3 of the drawings.

An adjustment bracket 60 is preferably attached to the support member 52 as best illustrated in FIGS. 2 and 4 of the drawings. The adjustment bracket 60 preferably includes an adjustment slot 62 that receives the stopper member 66 extending there through in an adjustable manner. The stopper member 66 further extends through a rear slot 27 within the frame 20 to engage a lower edge of a second target 70 to prevent the release of the second target 70. A nut 64 is preferably threadably attached to the stopper member 66 on the opposite side of the adjustment bracket 60 to secure the stopper member 66 in a selected vertical position within the adjustment slot 62 of the adjustment bracket 60. The stopper member 66 is preferably comprised of a threaded shaft structure with a head portion.

E. Operation of Invention

In use, the user first determines the velocity desired for the second targets 70 traveling through the shooting opening 26 and adjusts the stopper member 66 accordingly. Once the velocity is correctly determined, the user fills the target reservoir 25 with the second targets 70 as shown in FIGS. 3 and 4 of the drawings. The second targets 70 are preferably comprised of a circular disk structure that is either frangible (e.g. clay pigeons) or non-frangible (e.g. metal disk).

After the present invention is setup properly, the user then aims their firearm at the first target 50 extending to the side of the frame 20. The user then shoots a first bullet 12 from the firearm which strikes the first target 50 as shown in FIGS. 6*a* through 8*b* of the drawings. When the first target 50 is stricken by the first bullet 12, the stopper member 66 is moved rearwardly along with the support member 52 thereby allowing at least one of the second targets 70 to pass by the stopper member 66 in a downward manner. The bias member 59 forces the support member 52 and the stopper member 66 forwardly after the impact of the first bullet 12 thereby preventing the passage of further second targets 70. As the released second target 70 travels downwardly, the released second target 70 gains velocity and momentum. The released second target 70 travels through the track 30 and is redirected in a horizontal manner to the shooting opening 26. As the released second target 70 travels through the shooting opening 26 the user aims at the released second target 70 and shoots a second bullet 12 at the released second target 70. If the second bullet 12 hits the released second target 70, the released second target 70 is then forced rearwardly out of the guide slot 29 and the shooting opening 26 indicating a successful hit (the released second target 70 breaks apart if constructed of a frangible material). The user then continues the process until all of the second targets 70 are used and the process may then be repeated.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A moving shooting target system, comprising:

a frame including a shooting opening, a target reservoir and a track connecting said target reservoir with said shooting opening;

a support member pivotally attached to said frame;

a first target attached to said support member; and a stopper member attached to said support member, wherein said stopper member selectively engages a second target within said target reservoir to selectively prevent said second target from passing through said track to said shooting opening, wherein if a bullet strikes said first target said support member is pivoted so that said stopper member is positioned into a release position that releases at least one second target from said target reservoir.

2. The moving shooting target system of claim 1, wherein said shooting opening is substantially horizontal.

3. The moving shooting target system of claim 1, wherein said shooting opening has a height sufficient to see at least ninety-percent of a released second target.

4. The moving shooting target system of claim 1, wherein said target reservoir is positioned above said shooting opening.

5. The moving shooting target system of claim 1, wherein said track is aligned in a substantially vertical manner.

6. The moving shooting target system of claim 1, wherein said frame includes a guide slot extending downwardly from said shooting opening for guiding a released second target.

7. The moving shooting target system of claim 1, wherein said frame does not retain an upper portion of a released second target while said released second target travels through said shooting opening.

8. The moving shooting target system of claim 1, wherein said stopper member is adjustable to adjust a vertical drop distance for a released second target.

9. The moving shooting target system of claim 8, including an adjustment bracket attached to said support member, wherein said adjustment bracket includes an adjustment slot, wherein said stopper member extends through said adjustment slot and through a rear slot within said frame to engage a lower edge of a second target, and a nut threadably attached to said stopper member to secure said stopper member in a selected vertical position within said adjustment slot.

10. The moving shooting target system of claim 1, wherein said frame includes a handle.

11. The moving shooting target system of claim 1, wherein said frame includes a pair of feet extending forwardly.

12. The moving shooting target system of claim 11, including a pair of legs extending rearwardly from said frame.

13. The moving shooting target system of claim 12, wherein said pair of legs are adjustable in length and rotational position with respect to said frame.

14. The moving shooting target system of claim 1, wherein said frame is comprised of a front panel, a rear panel and a plurality of spacers attached between said front panel and said rear panel.

15. The moving shooting target system of claim 1, including a guide member that slidably receives a distal portion of said support member.

16. The moving shooting target system of claim 15, including a bias member positioned between said guide member and said support member to apply a forward biasing force upon said support member.

17. The moving shooting target system of claim 16, wherein said bias member is comprised of a compression spring.

18. The moving shooting target system of claim 17, including a receiver member attached to said support member that has a recessed portion that receives said compression spring.

19. A moving shooting target system, comprising:

a frame including a handle, a shooting opening, a target reservoir and a track connecting said target reservoir with said shooting opening, wherein said target reservoir is positioned above said shooting opening and wherein said track is aligned in a substantially vertical manner;

a pair of feet extending forwardly from said frame;

a pair of legs extending rearwardly from said frame, wherein said pair of legs are adjustable in length and rotational position with respect to said frame;

wherein said shooting opening is substantially horizontal and wherein said shooting opening has a height sufficient to see at least ninety-percent of a released second target;

wherein said frame includes a guide slot extending downwardly from said shooting opening for guiding a released second target;

wherein said frame is comprised of a front panel, a rear panel and a plurality of spacers attached between said front panel and said rear panel;

a support member pivotally attached to said frame;

a first target attached to said support member;

a guide member that slidably receives a distal portion of said support member;

a bias member positioned between said guide member and said support member to apply a forward biasing force upon said support member, wherein said bias member is comprised of a compression spring;

a receiver member attached to said support member that has a recessed portion that receives said compression spring;

a stopper member attached to said support member, wherein said stopper member selectively engages a second target within said target reservoir to selectively prevent said second target from passing through said track to said shooting opening, wherein if a bullet strikes said first target said support member is pivoted so that said stopper member is positioned into a release position that releases at least one second target from said target reservoir;

wherein said stopper member is adjustable to adjust a vertical drop distance for a released second target; and an adjustment bracket attached to said support member, wherein said adjustment bracket includes an adjustment slot, wherein said stopper member extends through said adjustment slot and through a rear slot within said frame to engage a lower edge of a second target, and a nut threadably attached to said stopper member to secure said stopper member in a selected vertical position within said adjustment slot;

wherein said frame does not retain an upper portion of a released second target while said released second target travels through said shooting opening.

* * * * *